United States Patent [19]

Hall

[11] 4,081,124

[45] Mar. 28, 1978

[54] CARTON WALL WITH REINFORCING RIB

[75] Inventor: David Y. Hall, Sharon, Conn.

[73] Assignee: Indian Head, Inc., New York, N.Y.

[21] Appl. No.: 704,637

[22] Filed: Jul. 12, 1976

[51] Int. Cl.[2] ..... B65D 5/12

[52] U.S. Cl. ..... 229/23 BT; 229/49; 220/441

[58] Field of Search ..... 229/49, 23 BT, 14 R; 206/205

[56] References Cited

U.S. PATENT DOCUMENTS

| | | | |
|---|---|---|---|
| 2,375,374 | 5/1945 | Lepp | 229/49 UX |
| 2,618,937 | 11/1952 | Francis | 206/205 X |
| 2,819,008 | 1/1958 | White et al. | 229/23 BT |
| 2,934,251 | 4/1960 | Kramer | 229/14 R |
| 3,097,781 | 7/1963 | Masi | 229/49 X |
| 3,159,326 | 12/1964 | Stonebanks | 229/49 X |
| 3,276,658 | 10/1966 | Locke | 229/23 BT X |
| 3,397,831 | 8/1968 | Adams | 229/14 R |
| 3,782,619 | 1/1974 | Dittbemmer | 229/14 R |

*Primary Examiner*—Davis T. Moorhead
*Attorney, Agent, or Firm*—Kenyon & Kenyon, Reilly, Carr & Chapin

[57] ABSTRACT

The disclosure relates to a folding container or carton having sidewall panels with at least one of the panels containing a reinforcing rib which extends vertically when the carton is erected. The rib projects toward the interior of the carton when the carton is erected. The provisions of the rib in a side panel of the carton increases the stiffness of the panel and prevent it from buckling in response to the pressure exerted on the panel by the material or goods contained within the carton. The reinforcing rib also acts as a column which increases the ability of the carton to carry the load of one or more cartons stacked upon another. The disclosure also relates to a jig or fixture which facilitates the erection of sidewall panels having reinforcing ribs by maintaining the rib in its erected form during the setting up of the carton and also to support the sidewall panels of the carton from deflecting or bulging when the carton is being filled with dense bulky material.

7 Claims, 6 Drawing Figures

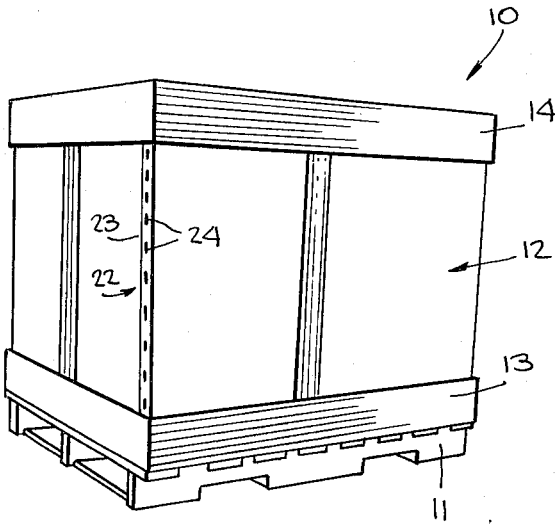
Fig. 1.
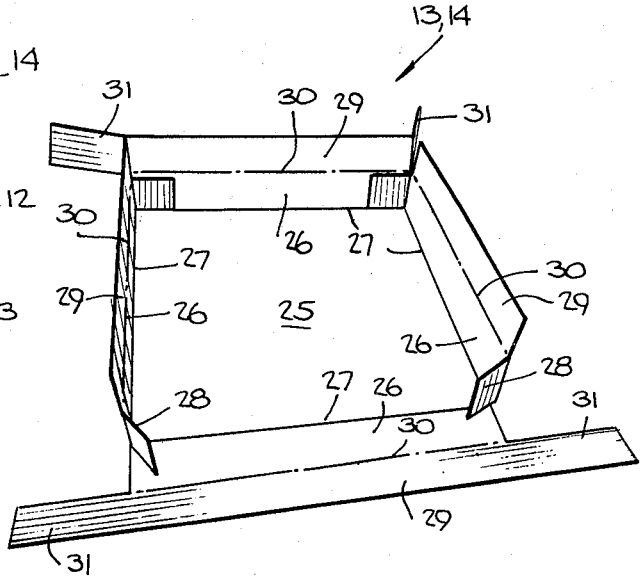
Fig. 3.
Fig. 2.
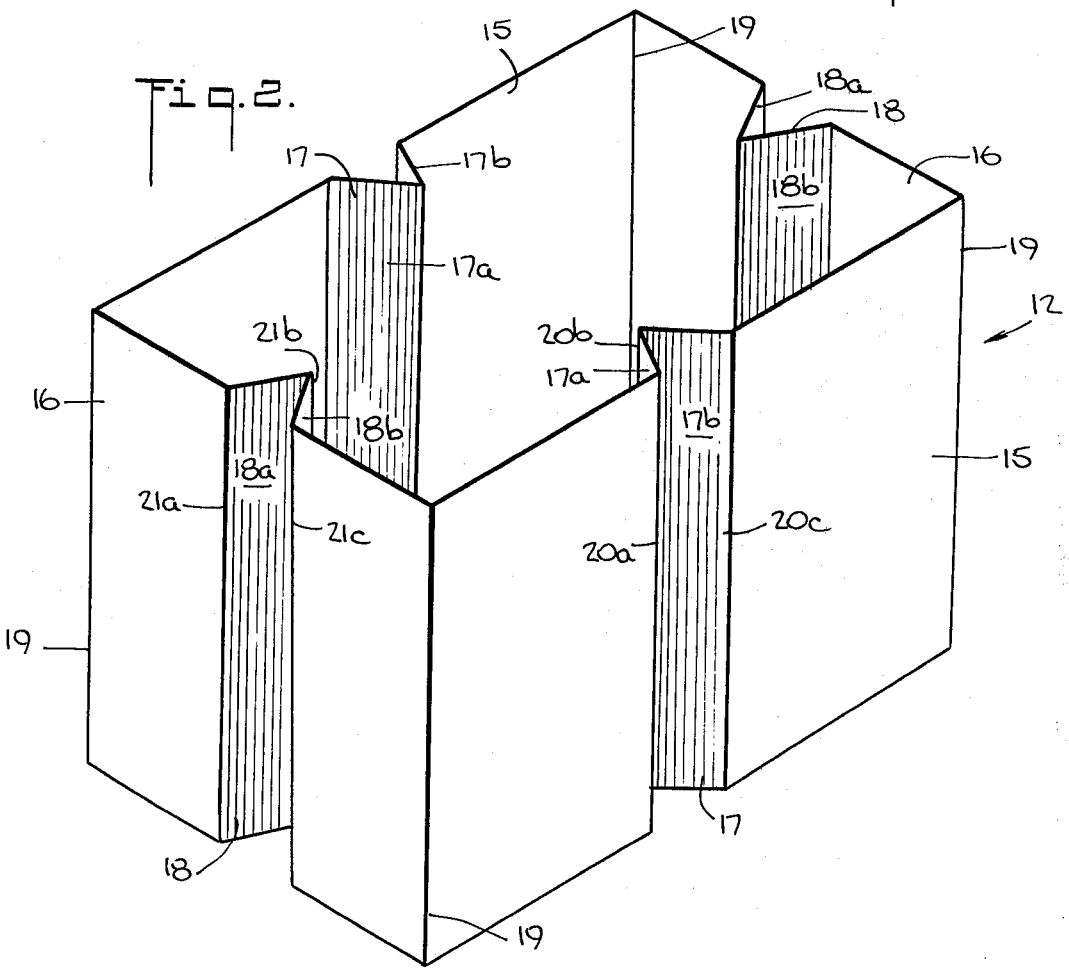

CARTON WALL WITH REINFORCING RIB

BACKGROUND OF THE INVENTION (a) Field of the Invention

The invention pertains to the field of reinforcing constructions for the panels of folding cartons to enable the cartons to withstand internal loading tending to burst the carton and stack loading tending to crush or collapse the carton.

(b) Description of the Prior Art

In U.S. Pat. No. 987,206 which issued on Mar. 21, 1911 to J. H. Wilson, there is disclosed a box which can be erected from separate sidewall panels of sheet metal and having a frame construction of wood or similar materials. Being of sheet metal and wood construction, the box is not a folding carton. The sheet metal sidewall panels each contain a V-shaped rib which extends vertically in the erected carton with the apex of the V-shaped rib disposed outwardly beyond the outer surface of the panel. The construction by which the reinforcing rib extends outwardly of the sidewall panel increases the envelope of the erected box for a given cubic interior volume thereof. Furthermore, the sheet metal construction of the U.S. Pat. No. 987,206 patent requires that the box have a wood frame to which the sheet metal sidewall panels are attached.

U.S. Pat. No. 3,097,781 which issued on July 16, 1963 to J. J. Masi shows a carton containing vertically extending reinforcing elements having a V-shape. The reinforcing elements can extend from an end portion of a sidewall panel and can be secured by staples or glue to hold the reinforcing element secure with respect to the interior surface of the sidewall panel. This construction requires that there be a separate panel whenever the panel is to have reinforced elements extending from the vertical edge portions of the panel. Furthermore, this construction results in the reinforcing elements being disposed within the corner portions of the carton.

A number of U.S. patents show inserts such as inserts or sleeves which are adapted to be disposed within the interior of cartons. The sleeves contain V-shaped vertically extending reinforcing elements. These patents include U.S. Pat. No. 2,618,937 which issued on Nov. 25, 1952 to E. J. Francis; U.S. Pat. No. 2,934,251 which issued on Apr. 26, 1960 to T. F. Kramer; U.S. Pat. No. 3,397,831 which issued on Aug. 20, 1968 to M. F. Adams, and U.S. Pat. No. 3,782,619 which issued on Jan. 1, 1974 to C. A. Dittbenner. The use of an insert having V-shaped ribs and being disposed within a separate carton increases the amount of carton material which must be provided and can increase the weight of the final carton for a given degree of strength. Furthermore, with the exception of the reinforcing members of the U.S. Pat. No. 3,097,781, the inserts are separate from the adjacent walls of the carton and accordingly require that loading be transmitted through the carton to the reinforcing member.

SUMMARY OF THE INVENTION

The container or carton as well as the carton blank of the invention have one or more reinforcing ribs which are defined by score lines extending across the side wall panel in a direction which is substantially vertical when the carton is erected. Accordingly, the reinforcing ribs are an integral part of the side wall panels of the carton and can be conveniently prepared by scoring the carton blank while in the flat form. By being integral with the side wall panels, the reinforcing ribs are conveniently erected into their operative form, such as a V-shaped form with its apex at the inside of the carton, during the erection of the sidewall panels of the carton. Since the reinforcing ribs extend inwardly from the interior surface of the sidewall panels, the ribs can increase the strength of the panels in resisting bursting from excessive internal pressure. This is due to the fact that the rib is retained in its normal form by the support of the sidewall panel adjacent thereto as the rib is urged in an outward direction. Thus, the reinforcing rib of the carton of the invention cannot be spread outwardly by internal pressure as could be the case with the reinforcing construction of U.S. Pat. No. 987,206 in which the apex of the rib is at the outside of the box. Where the sidewall panel construction of the invention having reinforcing ribs is used in conjunction with a top and bottom cap construction, the strength of the panels is further increased and thereby enabled to withstand greater internal pressure as well as greater stacking loads. Simplicity of manufacture and optimum utilization of the sidewall panels is obtained by the construction of the invention since the need to fabricate a reinforcing member separate from the remainder of the carton is eliminated. Furthermore, the problem or uncertainty of insuring that the reinforcing member act in conjunction with the carton side wall panels is also eliminated by the construction of the invention in which the ribs are an integral portion of the sidewall panels.

BRIEF DESCRIPTION OF THE DRAWINGS

FIG. 1 is a perspective view of the carton of the invention in its erected form;

FIG. 2 is a perspective view of a sleeve containing the reinforcing ribs of the invention;

FIG. 3 is a perspective view of the interior of a cap being assembled for use with the carton of the invention;

DESCRIPTION OF THE PREFERRED EMBODIMENTS

Figure 4:
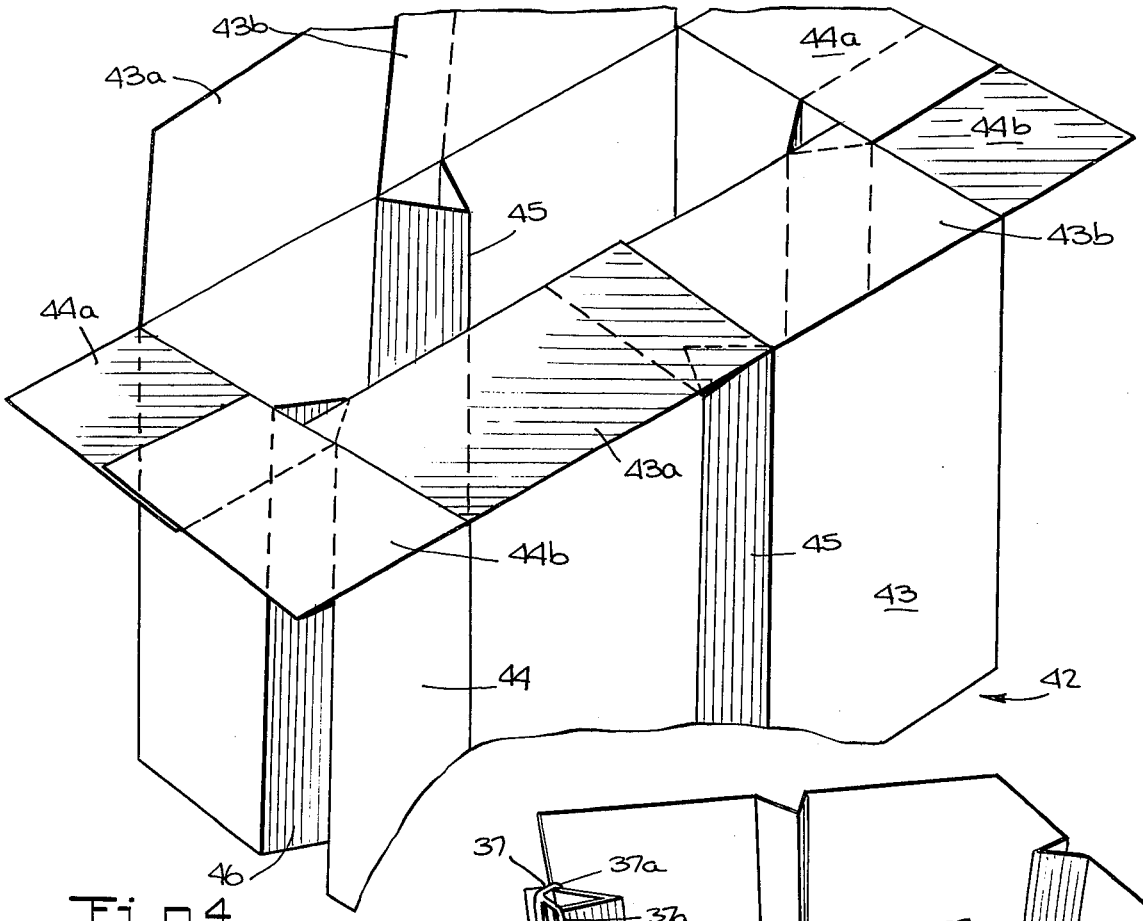
FIG. 4 is a perspective view of a carton containing the reinforcing ribs of the invention and end flaps.

As shown in FIG. 1 there is an embodiment of the invention which comprises folding container or carton 10. The carton is shown placed upon a pallet 11 of the type used for moving material by means of a fork-lift truck and for storing material in a warehouse or the like. Folding carton 10 comprises sleeve 12, bottom cap 13, and top cap 14.

As shown in FIG. 2, sleeve 12 comprises a plurality of sidewall panels 15 and 16 having formed therein reinforcing ribs 17 and 18, respectively. The sleeve is fabricated from sheet material such as corrugated paperboard. In order to obtain a high degree of strength, the sleeve 12 as well as the caps 13 and 14 of the carton can be formed from triple wall corrugated paperboard.

In forming the sleeve from said material, such as corrugated paperboard, a blank of the paperboard is provided with score lines 19 which are ultimately disposed at the corners of the erected sleeve. Reinforcing ribs 17 and 18 are formed by a plurality of score lines 20*a–c* and 21*a–c*, respectively. The blank from which the sleeve 12 is erected can have sidewall panels 15 and 16 in a single sheet with the opposite ends of the sheet connected by a stitched joint 22 such as that shown in FIG. 1. Joint 22 can also be formed by gluing or taping. Such a stitched joint includes flap 23 extending along a sidewall panel of the sleeve and a plurality of wire stitches or staples 24 connecting the flap to the sidewall panel adjacent thereto. Sleeve 12 can also be formed by the assembly of two blanks, each comprising a sidewall panel 15 and a sidewall panel 16 connected to one another by score line 19. In this arrangement the two sheets would be stitched to one another at their opposite ends by two rows of stitching and related end flaps. After fabrication, the sleeve is stored and ultimately shipped to a user in the collapsed or flat form with the panels 17*a, b* and the panels 18*a, b* disposed in the plane of the side wall panels adjacent thereto.

In FIG. 3 there is shown a cap construction which can comprise either or both of bottom cap 13 or top cap 14. Instead of a cap, other styles of retaining cartons such as HSC's (half-slotted containers), RSC's (regular slotted containers), sleeves, or combinations thereof can be used to close or retain either or both ends of sleeve 12. The cap can be of the high strength type, often used in shipping heavy articles such as household appliances and described in the trade as an "appliance cap." For maximum strength, the caps can be formed of triple wall corrugated paperboard. The cap includes a base panel 25 having inner side panels 26 attached to the base panel by score lines 27. An opposite pair of inner side panels 26 are provided with short end flaps 28. The cap further includes outer side panels 29 which are connected to inner side panels 26 along score lines 30. An oppositely disposed pair of outer side panels 29 are provided with elongated end flaps 31.

During erection of the cap, as shown in FIG. 3, inner side panels 26 are initially folded toward the base panel and thereafter short end flaps 28 are folded inwardly. Elongated end flaps 31 are folded outwardly with respect to outer side panels 29. Thereafter the outer side panels bearing the elongated end flaps are folded inwardly with respect to base panel 25 in the final step of erection. A pair of outer side panels 29 which lack elongated end flaps 31 are folded inwardly to overlap the elongated end flaps of the other pair of the outer side panels. In this way the folded inner and outer side panels provide a double thickness of paperboard material forming a flange or band surrounding the cap and having considerable tensile strength. As a result the end cap, when installed about sleeve 12, serves to support the upper end portions of the sleeve from moving outwardly.

Figure 5:
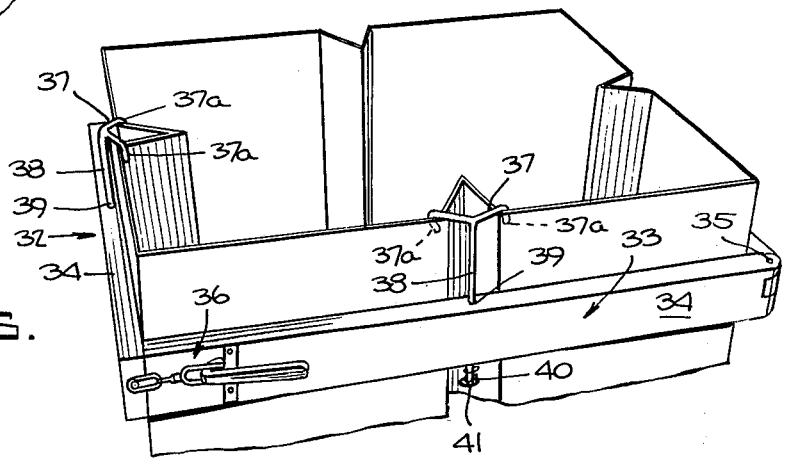
FIG. 5 is a perspective view of a fixture for retaining the reinforcing ribs in their operative form during erection of the carton of the invention and for supporting the carton during loading thereof.

As shown in FIG. 1 a carton having the reinforcing ribs 17 and 18 of the invention can include bottom cap 13 into which sleeve 12 is disposed. In placing sleeve 12 into bottom cap 13 it is necessary to erect the sleeve from the flat form in which the side wall panels 15 and 16 are parallel to one another and in which the panels 17*a, b* and 18*a, b* which make up the reinforcing ribs are co-planar with the side wall panels adjacent thereto. Initially the side wall panels are positioned to place the sleeve in a substantial hollow rectangular form. Thereafter, the panels 17*a, b* and 18*a, b* which are adapted to form the reinforcing ribs 17 and 18 are folded toward the interior of the sleeve about their respective score lines. As a result the reinforcing ribs assume a triangular form approaching the form shown in FIG. 2. Where the paperboard from which sleeve 12 is formed is of appreciable stiffness such as in the case where triple wall corrugated paperboard is used, it becomes necessary to maintain the reinforcing ribs in their operative form during assembly and subsequent loading of carton 10. As shown in FIG. 5 jug or fixture 32 can be used to retain the sleeve and its reinforcing ribs in the erected position during assembly of the carton. The fixture 32 comprises a band assembly 33 which comprises a plurality of elongated supports 34. In the case of a rectangular sleeve, the fixture can have at least two of the elongated supports 34 adjacent one another rigidly connected. The remaining supports can be articulated with respect to one another and the rigidly connected supports by hinges 35. One of the articulated supports which can be swung about one of hinges 35 is connected to a support 34 adjacent thereto by latch 36. The latch can be of the toggle-type which enables the band assembly to be tensioned upon closing the movable support 34 against the sleeve being erected.

In order to maintain the reinforcing ribs in their erected form in which they extend toward the interior of the sleeve, Y-shaped brackets 37 are provided. Brackets 37 each having hooks 37*a* at their free end portions are mounted on shafts 38 which extend through openings 39 in the supports of the band assembly. The lower end of each of shafts 38 which extend beneath the lower portion of the supports is provided with a coil spring 40 and a retainer 41 secured to the lower end of the shaft. With the sleeve and its reinforcing ribs erected as shown in FIG. 5 and with the band assembly 33 clamped about the sleeve, Y-shaped brackets 37 can be elevated with respect to the band assembly against the force of springs 40 and engaged with the upper edges of the panels forming reinforcing ribs 17 and 18. The hook 37*a* at the opposite ends of the Y-shaped brackets are then engaged with top edge and the inner surface of the reinforcing ribs to hold the ribs in their proper erected position. Thereafter, the carton can be filled while it remains supported by band assembly 33.

In the case where the carton is to be filled with bulk material such as material in a granular, pulverized, or powdered form, the material tends to apply outwardly directed forces to the sleeve analogous to those resulting from hydrostatic pressure, Thus, the outwardly directed forces tend to bulge and distort the sleeve outwardly. Each reinforcing rib due to its area moment of inertia in the horizontal plane provides a beam-like element extending vertically along the sidewall panel and opposing any tendency for the sidewall panel to bulge or bow outwardly. The construction by which each reinforcing rib 17 or 18 projects inwardly with respect to the sleeve enables it to act in the manner of an arch since internal forces applied to the panels 17*a, b* or 18*a, b* making up each of the ribs urge the panels against one another at the apex of each rib and against the sidewall panels adjacent thereto. By acting as an arch, the rib itself is maintained rigid in order that it can support the sidewall against outward deflection.

When the carton 10 has been loaded, the Y-shaped brackets (37, 37*a*) are disengaged and the top cap 14 is placed about the upper portion of the sleeve. The engagement of the inner and outer sidewall panels of the cap 14 with the outer surface of the sidewall panels of the sleeve enables the cap to act as a girth for retaining the sleeve in its rectangular erected form. Thereafter fixture 32 can be removed upon releasing latch 36 and swinging the articulated supports 34 away from the sleeve. During storage and movement of the loaded carton, the reinforcing ribs 17 and 18 continue to prevent bulging of the sleeve and thus maintain side wall panels 15 and 16 in a substantially planar form. In the planar form the sidewall panels have their greatest strength in resisting bursting pressure.

In typical use, carton 10 is subjected to stacking loads when one loaded carton is placed upon another. In this case the vertical load applied to sleeve 12 is in a direction tending to cause the sidewall panels 15 and 16 to be crushed or buckled. The provision of the reinforcing ribs opposes any tendency to crush or buckle since the reinforcing ribs 17 and 18 stiffen the side wall panels and at the same time act as columns for supporting stacking loads. Thus, to buckle or crush a sidewall panel having the reinforcing rib of the invention, it would first be necessary to exceed the column and crushing strength of the reinforcing ribs and cause them to fall and then to buckle or crush the sidewall panels. Furthermore, the reinforcing ribs of the invention enable the more central or middle regions of sidewall panels to be reinforced, realizing that the corners of sidewall panels are inherently reinforced by engagement with one another.

In FIG. 4 there is shown an embodiment of the invention in which container or carton 42 includes a sidewall panel construction similar to that of sleeve 12 with the addition of end closure flaps. Thus, the carton includes sidewall panels 43 and 44 from which end flaps 43*a, b* and 44*a, b* extend, respectively. The end flaps which are connected along score lines to their adjacent sidewall panels overlap one another adjacent to reinforcing ribs 45 and 46 when the carton is erected. Any of overlapping portions 43*a'*, 43*b'*, and 44*a'*, 44*b'* of the end flaps can be secured to one another by adhesive or wire stitching during erection of the carton in order to maintain the reinforcing rib and the sidewall panel adjacent thereto in the proper erected form. In such an event it may be unnecessary to employ fixture 32 during erection and loading of the carton. This arrangement of end flaps can be used to not only close the top but also the bottom of carton 42.

In accordance with the invention the reinforcing ribs can be provided in each of the sidewall panels of a container or carton, in oppositely disposed sidewall panels, or in various other permutations. In addition, a given sidewall panel can be provided with a plurality of reinforcing ribs spaced apart from one another. Thus for example, a carton having an elongated rectangular form could have a plurality of ribs in the elongated sidewall panels and one rib in the short sidewall panels.

The reinforcing rib can be triangular in form as shown in the drawings; however, by the provision of additional panels and score lines forming the reinforcing rib, various different polygonal rib forms can be employed. Where the rib has a triangular form the included angle of the panels forming the rib can be in the range extending from about 20°–120°, by way of example.

Containers or cartons in accordance with the invention, further by way of example, having been fabricated from triple wall corrugated paperboard in the sizes of 46 inches long, 38 inches wide and 45 inches high. Certain of such cartons were tested when mounted on 48by 40 inch pallets. The reinforcing rib of such cartons had 6 inch wide panels erected into a triangular form having a 4 inch base. Notwithstanding the size of such cartons as described above, the carton wall construction of the invention having one or more reinforcing ribs can be used with smaller and larger cartons, with cartons of polygonal forms other than rectangular, and with various wall materials including different types of corrugated paperboard material.

Figure 6:
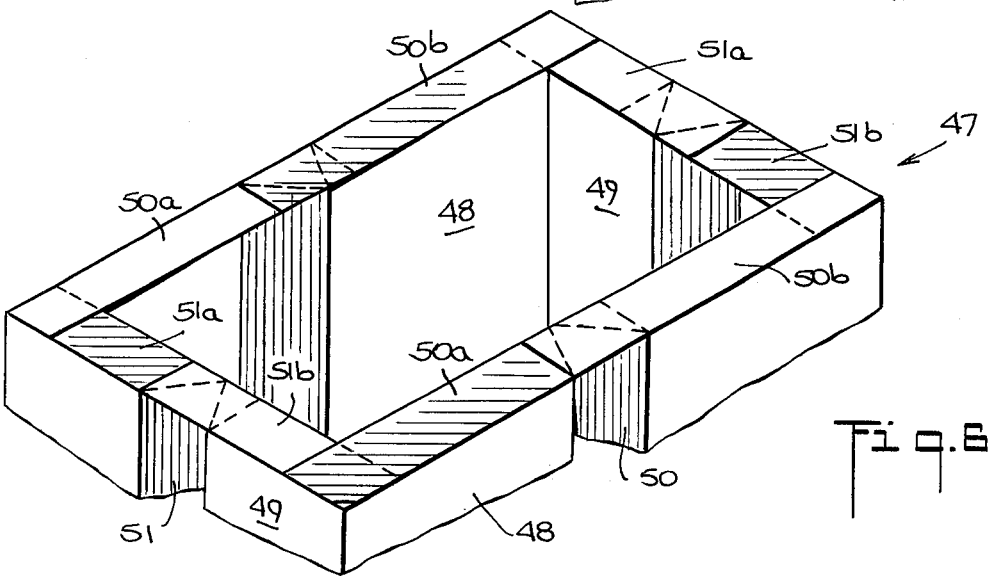
FIG. 6 is a perspective view of the carton of the invention showing end flaps for securing the ribs in the erected form.

As shown in FIG. 6 container or carton 47 having sidewall panels 48 and 49 is provided with reinforcing ribs 50 and 51. To facilitate erection of carton 47 and to make it unnecessary to use a fixture or jig such as that shown in FIG. 5, the carton is provided with end flaps 50*a, b* and 51*a, b*. The inner end portions of each of these end flaps is slotted along the score line from which the end flaps extend and cut transversely across the width of the end flaps.

During erection of the carton the inner end portions of an adjacent pair of end flaps are overlapped and secured to one another by adhesive or stitching. Upon securing the overlap or lapping end portions the reinforcing rib adjacent thereto is secured into its proper erected form. This procedure can be followed for each of the remaining pairs of end flaps in order to progressively secure each of the reinforcing ribs in its erected form. Since the end flaps 50*a, b* and 51*a, b* are comparatively narrow in width they do not excessively obstruct access to the interior of the carton. This is especially true where the carton is to be filled with bulk material. If desired the carton can be closed by the use of caps such as those shown in FIG. 1.

The carton can also be retained during erection by setting-up sleeve 12 with its lower portion nested within an open frame. The frame which can be formed of angle-iron or the like can be attached to the supporting pallet or the open frame can simply be secured to the bottom of the carton. The open frame can also be used to support the top portion of the sleeve.

What is claimed is:

1. A folding paper board container comprising a bottom and a sidewall structure having a plurality of hingedly interconnected sidewall panels, said sidewall structure when erected being mounted on and forming an enclosure overlaying said bottom, at least two of said plurality of sidewall panels having integral, collapsible, vertically extending reinforcing means projecting inwardly with respect to said enclosure beyond the inner surface of said sidewall panel when said container is erected, said container including said reinforcing means being operative to be folded into a substantially flat structure and expanded to erect said container and form said enclosure, said container further comprising means for maintaining said sidewall structure expanded comprising a plurality of flaps, each of said flaps being hingedly secured to one end of a respective sidewall panel having said reinforcing means and being slotted adjacent said reinforcing means, each of said flaps being operative to be folded at a substantially right angle to a respective sidewall panel and portions of each of said flaps being separated by slotting for overlaying and securing the separated portions, whereby said sidewall structure may be maintained in expanded form.

2. A fiberboard folding container comprising a bottom and a sidewall structure having a plurality of hingedly-interconnected sidewall panels, said bottom and said sidewall structure being integral and hingedly interconnected and said sidewall structure when erected being mounted on and forming an enclosure overlaying said bottom, at least two of said plurality of sidewall panels having integral, collapsible, vertically extending reinforcing means projecting inwardly with respect to said enclosure beyond the inner surface of said sidewall panels when said container is erected, said container including said reinforcing means being operative to be folded into a substantially flat structure and expanded to erect said container and form said enclosure.

3. The container of claim 1, wherein said bottom comprises a plurality of flaps, one for each sidewall panel, each said flap being hingedly connected to a respective sidewall panel at the bottom thereof, said container further comprising a plurality of score lines each being positioned between a respective sidewall panel and flap.

4. A sleeve for a folding paper board container comprising a plurality of interconnected sidewall panels operative to form an enclosure for said container, said sidewall panels being hingedly interconnected in a unitary expanded structure, at least two of said plurality of sidewall panels having integral, collapsible, vertically extending reinforcing means projecting inwardly with respect to said enclosure beyond the inner surface of said sidewall panels when said unitary structure is expanded, said unitary structure including said reinforcing means being operative to be folded into a substantially flat structure and expanded to form said enclosure, said sleeve further comprising means for maintaining said unitary structure in an expanded form during erection of said container including a plurality of flaps, a different one of said flaps being hingedly secured to one end of each of said sidewall panels having said reinforcing means, each said flap being slotted adjacent said reinforcing means, each said flap being operative to be folded at a substantially right angle to a respective sidewall panel and portions of the flap separated by slotting being operative to be overlayed and secured, whereby said unitary structure is maintained in expanded form.

5. The sleeve of claim 4, wherein each said flap is slotted proximate the center of said reinforcing means and secured thereat, each said flap being longitudinally slotted for the length of said reinforcing means and transversely slotted for the width of each said flap.

6. A fiberboard folding container comprising a bottom and a sidewall structure having a plurality of hingedly-interconnected sidewall panels, said sidewall structure when erected being mounted on and forming an enclosure overlaying said bottom, at least two of said plurality of sidewall panels having integral, collapsible, vertically extending reinforcing means projecting inwardly with respect to said enclosure beyond the inner surface of said sidewall panels when said container is erected, said container including said reinforcing means being operative to be folded into a substantially flat structure and expanded to erect said container and form said enclosure, said container further comprising maintaining means for maintaining said sidewall structure in expanded form, said maintaining means including a plurality of flaps, a different one of said flaps being hingedly secured to one end of each of said sidewall panels having said reinforcing means, each said flap being slotted adjacent said reinforcing means, each said flap being operative to be folded at a substantially right angle to a respective sidewall panel and portions of the flap separated by slotting being operative to being overlayed and secured, whereby said unitary structure is maintained in expanded form.

7. The container of claim 6 wherein each said flap is slotted proximate the center of said reinforcing means and secured thereat, each said flap being longitudinally slotted for the length of said reinforcing means and transversely slotted for the width of each said flap.

* * * * *

UNITED STATES PATENT AND TRADEMARK OFFICE

CERTIFICATE OF CORRECTION

PATENT NO. : 4,081,124

DATED : March 28, 1978

INVENTOR(S) : David Y. Hall

It is certified that error appears in the above-identified patent and that said Letters Patent are hereby corrected as shown below:

Col. 4, line 7
delete "jug" insert -- jig --

Col. 4, line 37
delete "hook" insert -- hooks --

Col. 5, line 65 delete "48by" insert -- 48 inch by --

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*